US006550800B2

(12) United States Patent
Creton

(10) Patent No.: US 6,550,800 B2
(45) Date of Patent: Apr. 22, 2003

(54) RETAINING DEVICE OF A SKI BOOT ON A SKI

(75) Inventor: Gérard Creton, Mont St-Martin (FR)

(73) Assignee: Emery, SA, Fontanil le Cornillon (FR)

( * ) Notice: Subject to any disclaimer, the term of this patent is extended or adjusted under 35 U.S.C. 154(b) by 55 days.

(21) Appl. No.: 09/812,631

(22) Filed: Mar. 20, 2001

(65) Prior Publication Data

US 2001/0024029 A1 Sep. 27, 2001

(30) Foreign Application Priority Data

Mar. 23, 2000 (FR) ..... 00 03733

(51) Int. Cl.[7] ..... A63C 9/00

(52) U.S. Cl. ..... 280/613; 280/627; 280/629

(58) Field of Search ..... 280/614, 615, 280/617, 627, 629, 630, 631, 632, 633, 634, 635, 14.24, 613, 618, 623, 626, 628

(56) References Cited

U.S. PATENT DOCUMENTS

| | | | | | |
|---|---|---|---|---|---|
| 2,072,477 | A | * | 3/1937 | Dodd | 280/614 |
| 4,398,747 | A | * | 8/1983 | Bernard et al. | 280/630 |
| 4,709,942 | A | * | 12/1987 | Dimier et al. | 280/618 |
| 4,889,358 | A | * | 12/1989 | Rullier | 280/628 |
| 4,911,464 | A | * | 3/1990 | Gallet et al. | 280/625 |
| 4,938,497 | A | * | 7/1990 | Goud | 280/625 |
| 5,092,621 | A | * | 3/1992 | Horn | 280/618 |
| 5,121,939 | A | * | 6/1992 | Peyre | 280/625 |
| 5,213,356 | A | * | 5/1993 | Rohrmoser | 280/607 |
| 5,560,634 | A | | 10/1996 | Challande et al. | 280/634 |
| 5,639,108 | A | * | 6/1997 | Challande et al. | 280/607 |
| 5,799,966 | A | * | 9/1998 | Haldemann | 280/613 |
| 5,890,731 | A | * | 4/1999 | Challande et al. | 280/625 |
| 5,997,026 | A | * | 12/1999 | Klubitschko et al. | 280/607 |
| 6,092,831 | A | | 7/2000 | Bauvois | 280/625 |

FOREIGN PATENT DOCUMENTS

| | | | | |
|---|---|---|---|---|
| DE | 11 90 852 | | 5/1961 | |
| EP | 0 429 890 | | 6/1991 | |
| EP | 0 634 197 | | 1/1995 | |
| EP | 0 807 453 | | 11/1997 | |
| EP | 0 914 847 | | 5/1999 | |
| FR | 2 625 911 | | 7/1989 | |
| FR | 2652753 | A1 * | 4/1991 | A63C/5/03 |
| WO | WO 9316770 | A1 * | 9/1993 | A63C/9/081 |

* cited by examiner

*Primary Examiner*—Paul N. Dickson
*Assistant Examiner*—Laura B. Rosenberg
(74) *Attorney, Agent, or Firm*—Fay, Sharpe, Fagan, Minnich & McKee, LLP

(57) ABSTRACT

A retaining device is disclosed for retaining the front end of an associated boot (50) on an associated ski (3). A movable jaw (4) pivots on a base (6) around a vertical axis (7) against the action of an elastic return means (8). The elastic return means (8) includes two actuating arms (10*a*, 10*b*), acted upon by an elastic system (11). Each of the actuating arms (10*a*, 10*b*) pivots independent of the jaw (4) around a pivot axis (15*a*, 16*b*). The jaw (4) cooperates with the actuating arms (10*a*, 10*b*) via a driving element (9). The elastic return means (8) is arranged below the front end of the associated boot (50) in back of the transverse plane (T) which passes through the pivot axis (7) of the jaw (4).

15 Claims, 5 Drawing Sheets

50

1
4
7
T
5
z
40
90
91
8
13
9
12
2
26
15a
6
10a
3

14b

16b
T
15b
140b
141b
10b
17 b
B
11
C
P
40
A
A
C
B
12
91
17 a
13
9
15a
10a
4
16a
141a
140a
14a

RETAINING DEVICE OF A SKI BOOT ON A SKI

BACKGROUND OF THE INVENTION

The present invention concerns a retaining device for retaining a ski boot on a ski, snowboard, or the like. The invention concerns, more particularly, an improvement of the frontal binding which retains, in releasable fashion, the front end of the user's boot on a ski. However, it is to be appreciated that the invention is also applicable to other applications and is not limited to the aforementioned applications.

In general, the boot of a skier is retained on the ski in a disengageable fashion at its front end by a frontal binding commonly called a "thrust restraint" and at its rear end, specifically at its heel, by a rear binding commonly called a "heel restraint".

In case of significant stresses, when the leg or the joints of the skier are in danger, the release of the ski boot takes place either from the front or from the rear of the boot or from both locations at once. To that end, the thrust restraint typically comprises a jaw which pivots at least laterally around a vertical axis. The heel restraint typically comprises a jaw which pivots in an upward direction around a transverse axis. The jaws of the thrust and heel restraints are each acted upon by an elastic system including a release or disengagement spring, whose compression is regulated in order to provide the skier with an assured stress value for the release of his boot.

Many front safety bindings are known which hold the front of a boot on a ski to permit skiing while providing for boot release when the leg appears to be under dangerous stress. These thrust restraints include a pivoting jaw, acted upon in centered retaining position by an elastic system, such as a spring.

The present invention contemplates a new and improved apparatus which is very compact, comprises a minimum of parts, and retains the front end of the boot in a releasable manner according to which the zone towards the front beyond that of the jaw is released.

SUMMARY OF THE INVENTION

According to one aspect of the invention, a binding more particularly adapted to releasably retain the front end of an associated boot of a skier is disclosed. The binding includes a movable jaw which pivots on a base around a vertical axis against the action of elastic return means. The elastic return means includes two actuating arms, acted upon by an elastic system. Each of the actuating arms pivots around a pivoting axis independently from the jaw. The jaw cooperates with the actuating arms via a driving element, which is an integral part of said elastic return means. The driving element is arranged beneath the front end of the boot, behind the transverse plane passing through the pivot axis of the jaw. The elastic system can be of any type, such as, for example, of the type functioning on compression or on tension or on twisting.

According to another aspect of the invention, the two actuating arms are acted upon by the elastic system against at least one fixed support stop. The driving element includes a cylindrical projection extending toward the bottom and whose axis is beneficially arranged in back in relation to the pivot axis of the jaw.

According to another aspect of the invention, each of the two arms is a lever of the third kind, according to which the application point of the force is arranged between the point of support, i.e. the pivoting point of the arm and the point of resistance, i.e. the point of application of the elastic system.

According to another characteristic, the driving element is connected to the jaw by the intermediary of a front plate which extends somewhat horizontally, and on which the bottom of the front of the sole of the boot may rest in order to constitute support means towards the bottom for same.

Preferably, the driving element is a cylindrical projection which is preferably retained in centered position by two actuating rails, realized on two actuating arms. Each of the two actuating rails are preferably realized by the front edge of the first portion of an actuating arm. Each rail preferably further includes a first portion of the rail, or retaining rail, which is extended by a second portion of the rail, or disengagement rail. The passage of the actuating element of the first portion of the rail at the second portion of the rail thus ensures that the disengagement force value releases the boot.

Preferably, the retaining device according to the invention is characterized in that each of the actuating arms, the left arm and the right arm, is respectively articulated around a pivot axis. Each actuating arm preferably stretches out beneath the zone occupied by a first portion of the end of the boot and extends in the direction of the plane of symmetry. Each actuating arm additionally includes a second portion which extends side by side toward the rear. The extremities of the second portions of the two actuating arms are acted upon by the elastic system against the fixed stop.

In one embodiment, the base is fixed to the ski, whereas in another embodiment the retaining device is arranged at the front of a pivoting plate articulated at its front end around a transverse pivot axis.

According to yet another embodiment, the base is articulated around the transverse pivot axis in order to be extended toward the rear so as to constitute the pivoting plate. The pivoting plate includes at the front the retaining jaw, and at the rear the retaining means which retains the rear of the boot.

It is to be appreciated that the embodiment of the binding which releases the front zone of the jaw is adapted for cross-country skis which require heel play for the user when moving.

Other advantages of the invention will be evident to those of ordinary skill in the art from the examples described in the following detailed description and the attached drawings.

BRIEF DESCRIPTION OF THE DRAWINGS

The invention may take form in various components and arrangements of components, and in various steps and arrangements of steps. The drawings are only for the purposes of illustrating preferred embodiments and are not to be construed as limiting the invention.

DETAILED DESCRIPTION OF THE PREFERRED EMBODIMENTS

Figure 1:
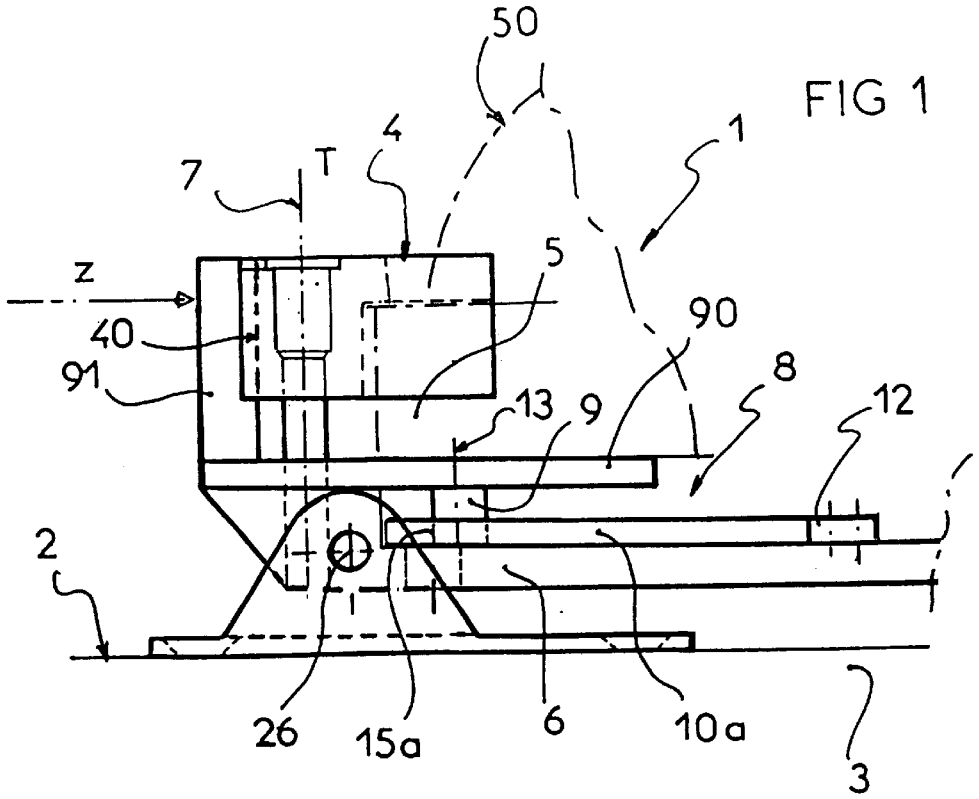
FIG. 1 shows a lateral view of a front binding in accordance with a first embodiment of the invention.
Figure 2:
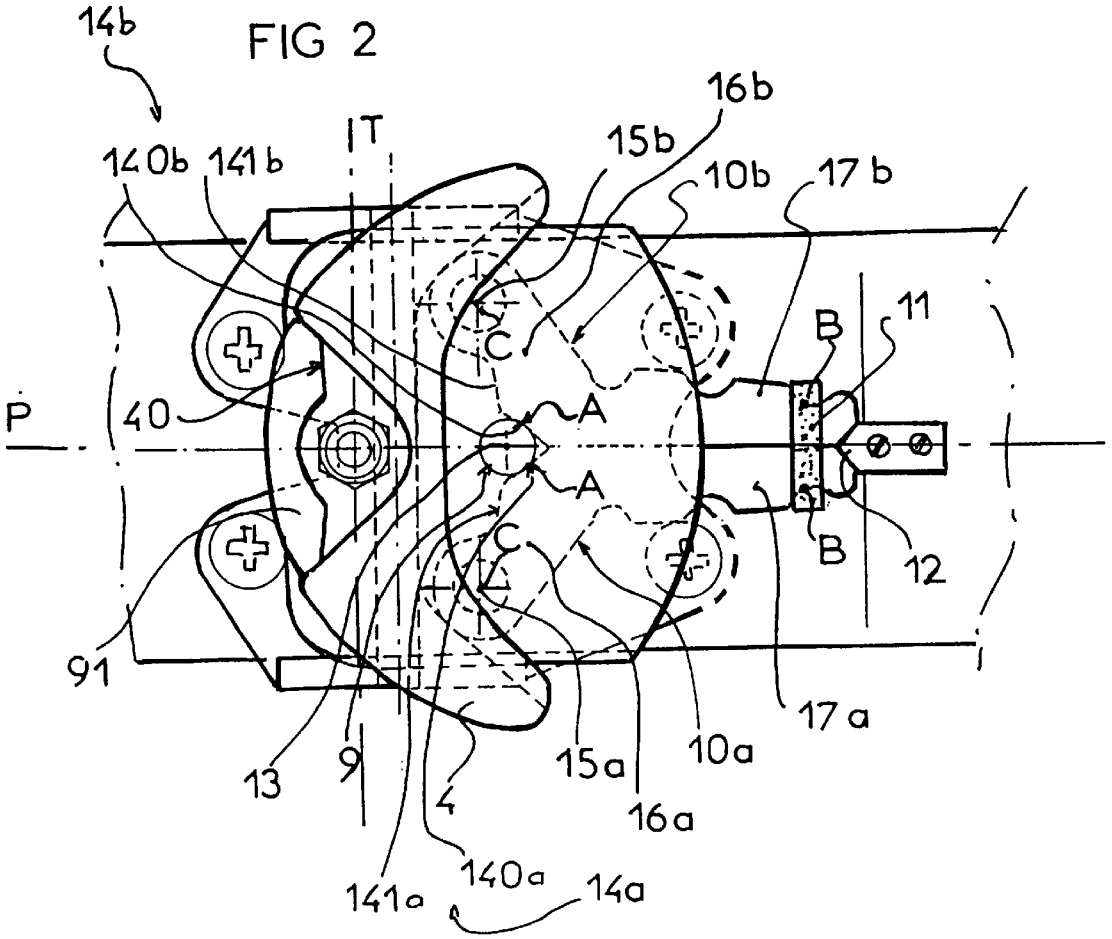
FIG. 2 shows a view from above of the embodiment of FIG. 1.

According to a preferred embodiment illustrated in FIGS. 1–4, a front binding 1 is centered about a longitudinal plane of general symmetry P and is fixed on an upper surface 2 of an associated ski 3. The front binding 1 includes a retaining jaw 4 for retaining an associated boot 50. The retaining jaw 4 envelopes or encases a front 5 of the associated boot 50. The jaw 4 is arranged in a pivoting fashion on a base 6 around a vertical axis 7 extending upward in the plane of symmetry P.

The jaw 4 is acted upon and maintained in centered retaining position by an elastic, resiliently biased return means 8 which includes a cylindrical driving projection or element 9 projecting from a front plate 90, two actuating arms 10*a* and 10*b*, an elastic or spring system 11 and a fixed support stop 12.

The driving element 9 is connected to the jaw 4 via a front plate 90. In the preferred embodiment, the driving element 9 is a cylindrical driving projection 9 which extends downward from the front plate 90 and has an axis 13 which is beneficially arranged in back relative to the vertical pivot axis 7 of the jaw 4.

Accordingly, the cylindrical driving projection 9 is retained in centered position by two actuating rails 14*a*, 14*b* disposed upon the two actuating arms 10*a*, 10*b*.

The cylindrical driving projection 9 is connected to the jaw 4 via the front plate 90. The front plate 90 extends approximately horizontally to provide bottom support for the front of the sole of the boot 50. The front plate 90 also includes at its front end a vertical projection 91 extending in an upward direction. The vertical projection 91 conforms with the front surface 40 of the jaw 4 so that the jaw 4 and the front plate 90 pivot together, and the pivoting provokes the driving of the cylindrical driving projection 9. The jaw 4 also includes a height control means 41 by which the jaw 4 is movable in vertical translation with respect to the vertical projection 91, assuring its guidance.

As described previously, the return means 8 includes two actuating arms 10*a*, 10*b* which pivot toward a centered position pressing against the fixed support stop 12 due to the action of the elastic system 11.

Each of the actuating arms, namely the left arm 10*a* and the right arm 10*b* is respectively articulated around a pivot axis 15*a*, 15*b*. The actuating arms 10*a*, 10*b* include a first portion 16*a*, 16*b* which extend under a zone occupied by the end of the associated boot 50 in direction of the plane of symmetry P. A second portion 17*a*, 17*b* extend from the first portion 16*a*, 16*b* in side by side fashion towards the rear. The extremities of the second portion 17*a*, 17*b* are acted upon by the elastic system 11 against the fixed stop 12.

It is to be appreciated that both the cylindrical driving projection 9 and the fixed stop 12 are arranged in the plane of symmetry P. The two actuating arms 10*a*, 10*b* are beneficially symmetrically placed with respect to the plane of general symmetry P.

In addition and according to a characteristic of the invention, the elastic return means 8 are arranged under the front end 5 of the associated boot 50. Thus, the cylindrical driving projection 9, the two actuating arms 10*a*, 10*b*, the elastic system 11, and the fixed support stop 12 are arranged behind a transverse plane T passing through the vertical pivot axis 7 of the jaw 4, or in other words are arranged on a side AR (FIG. 4) with respect to the transverse plane T.

The two actuating rails 14*a*, 14*b* are preferably realized by a front edge of the first portion 16*a*, 16*b* of the actuating arm 10*a*, 10*b*. Each of the rails 14*a*, 14*b* comprises a first rail portion or retaining rail portion 140*a*, 140*b* and a second rail portion or disengagement rail portion 141*a*, 141*b*. The force required to pass the cylindrical driving projection 9 from the first rail portion 140*a*, 140*b* to the second rail portion 141*a*, 141*b* defines a disengagement force value that releases the associated boot 50. The configuration of the first rail portion 140*a*, 140*b* creates a value of the elastic return force as well as the variation of said force according to the displacement of the associated boot 50. In other words, the shape of the disengagement curve is defined by the shape and the dimension of the rail 14*a*, 14*b*, and so the disengagement curve may be modified by means of modification of the rail 14*a*, 14*b*.

Figure 3:
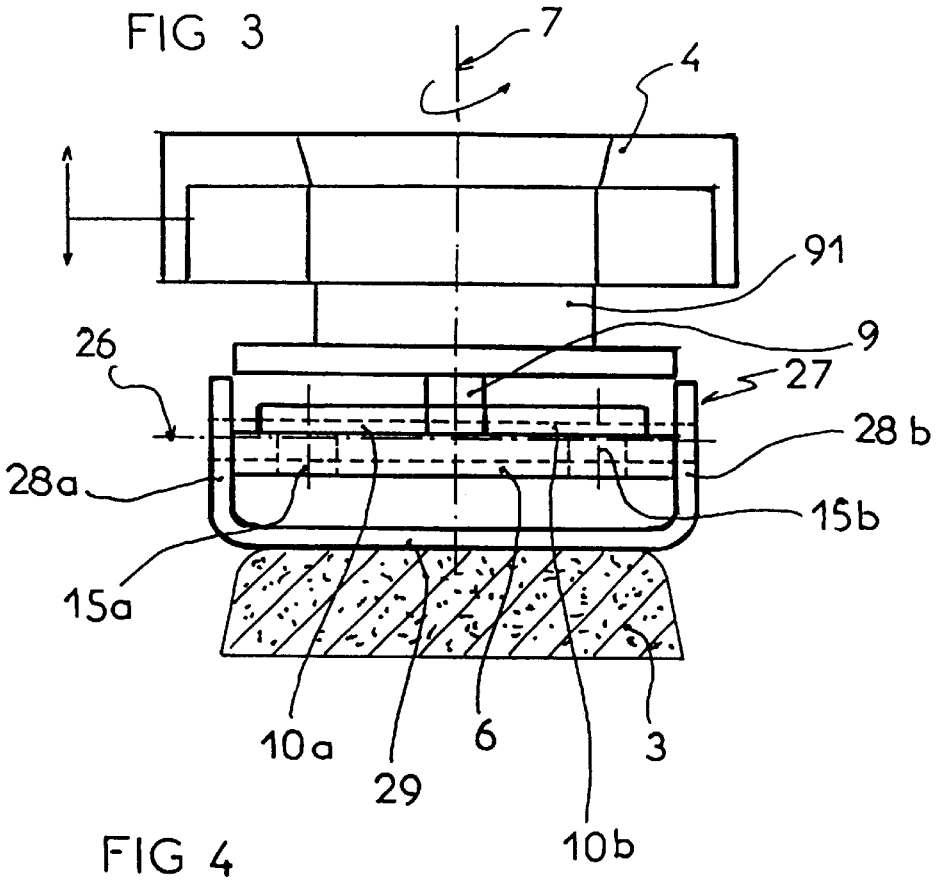
FIG. 3 shows an end view from the rear of the embodiment of FIG. 1.
Figure 4:
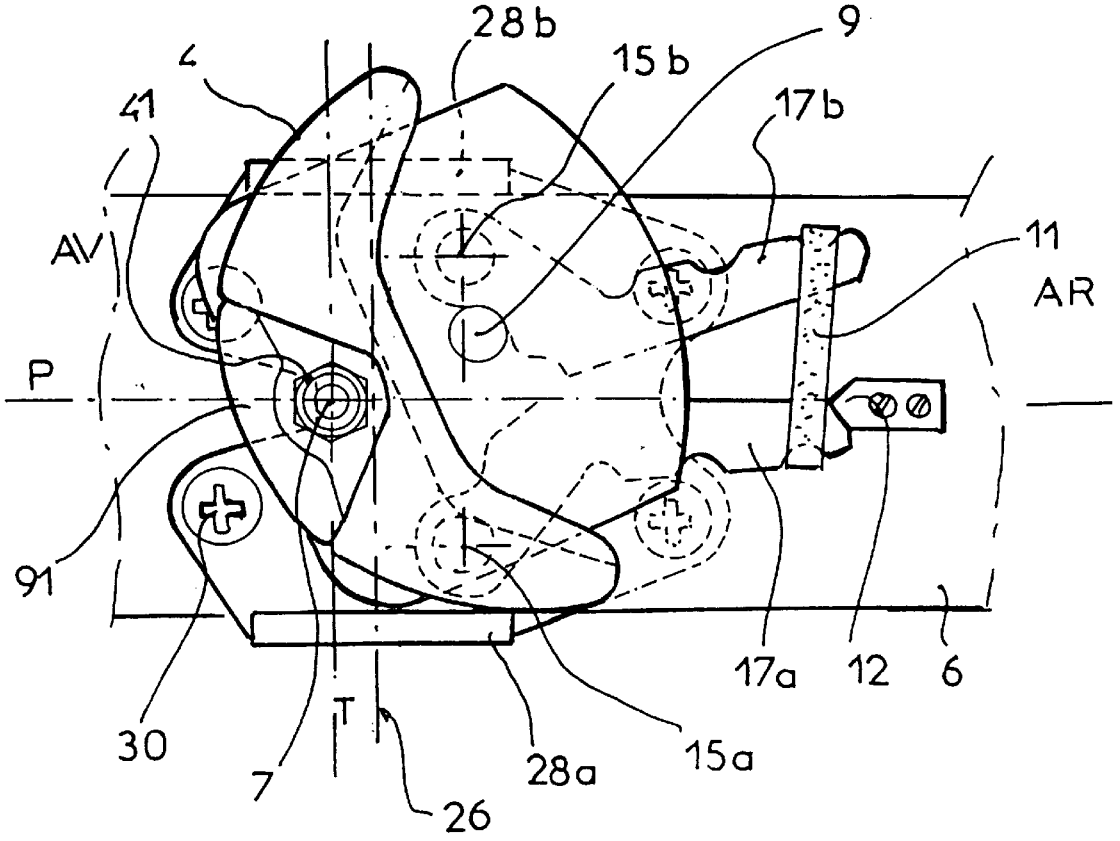
FIG. 4 shows a view from above of the embodiment of FIG. 1 where the associated boot has rotated into the disengagement position.

The elastic return system 11 in centered position of the actuating arms 10*a*, 10*b* can be of any type, such as, for example, of the type illustrated in FIGS. 1 to 5. According to that embodiment, the elastic return system 11 includes an elastic ring 11 enclosing the two second portions 17*a*, 17*b* of the two actuating arms 10*a*, 10*b*. As the jaw 4 pivots about its pivot axis 7, the cylindrical driving projection 9 drives the corresponding actuating arm 10*b* pivotally about its pivot axis 15*b* as shown in FIG. 4. The pivotal movement of the actuating arm 10*b* causes extension and elastic deformation of the elastic ring 11 which tends to return the corresponding actuating arm 10*b* to the stop 12. The elastic ring 11 is preferably made of elastomer or similar type material.

Figure 8:
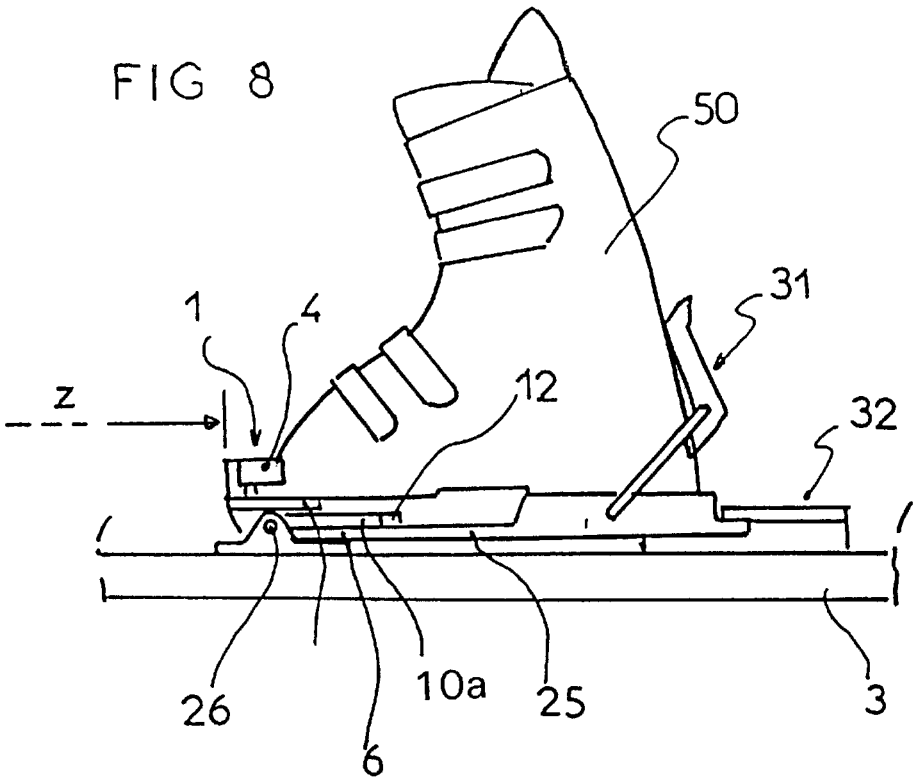
FIG. 8 shows a side view of a cross-country ski with a boot binding constructed in accordance with the embodiment of the invention shown in FIGS. 1–5, where the rear retention system is retaining the pivot plate.
Figure 9:
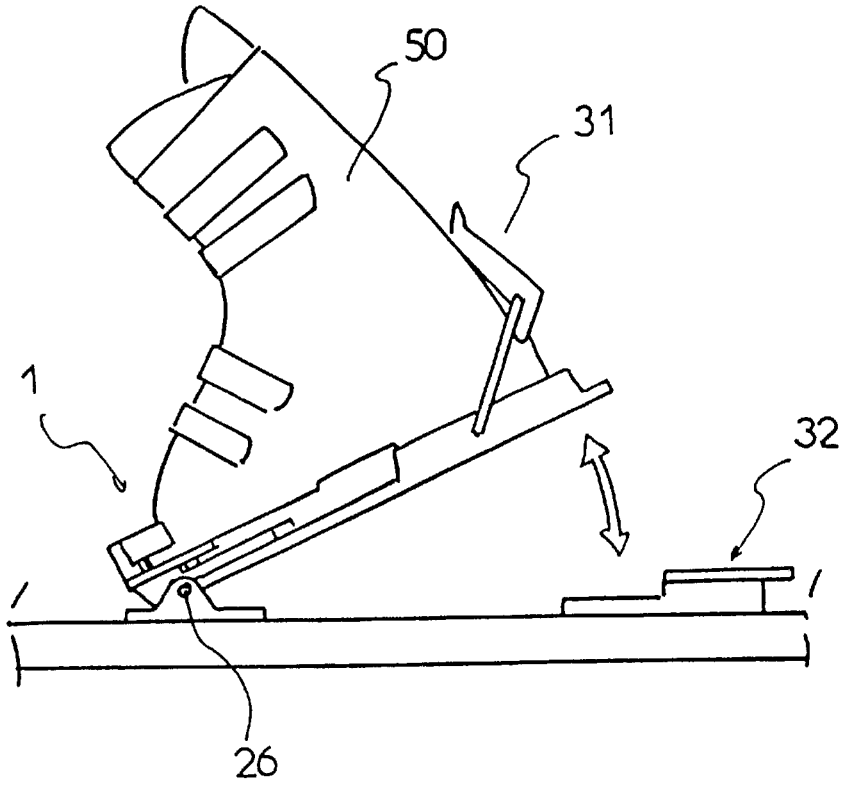
FIG. 9 shows a side view of the ski of FIG. 8, where the rear retention system has released the pivot plate.

The front binding 1 of the invention can, of course, be used in conjunction with any type of ski. With continuing reference to FIGS. 1–4 and with further reference to FIGS. 8–9 a preferred embodiment is described for use in conjunction with an Alpine skis typically used in cross-country skiing. With particular reference to FIGS. 8 and 9, the front binding 1 of the embodiment is arranged in front of a pivoting plate 25. The base 6 is articulated around a transverse pivot axis 26, and additionally extends toward the rear to form the pivoting plate 25. The pivot axis 26 is retained by an installation mounting 27. As seen in FIG. 3, the installation mounting 27 includes two lateral walls 28*a* and 28*b* and a base plate 29. The lateral walls 28*a* and 28*b* retain the transverse pivot axis 26, and connect to the base plate 29 which in turn connects to an associated ski 3 by a set of screws 30.

With particular reference again to FIGS. 8–9, the rear end of the pivot plate 25 includes a retention means 31 which retains the back of the associated boot 50. A movable rear retention system 32 retains the rear of the pivoting plate 25 on the associated ski 3, as shown in FIG. 8, or releases same as shown in FIG. 9 to permit pivoting in an upward direction of the pivot plate 25 around its transverse pivot axis 26.

Figure 10:
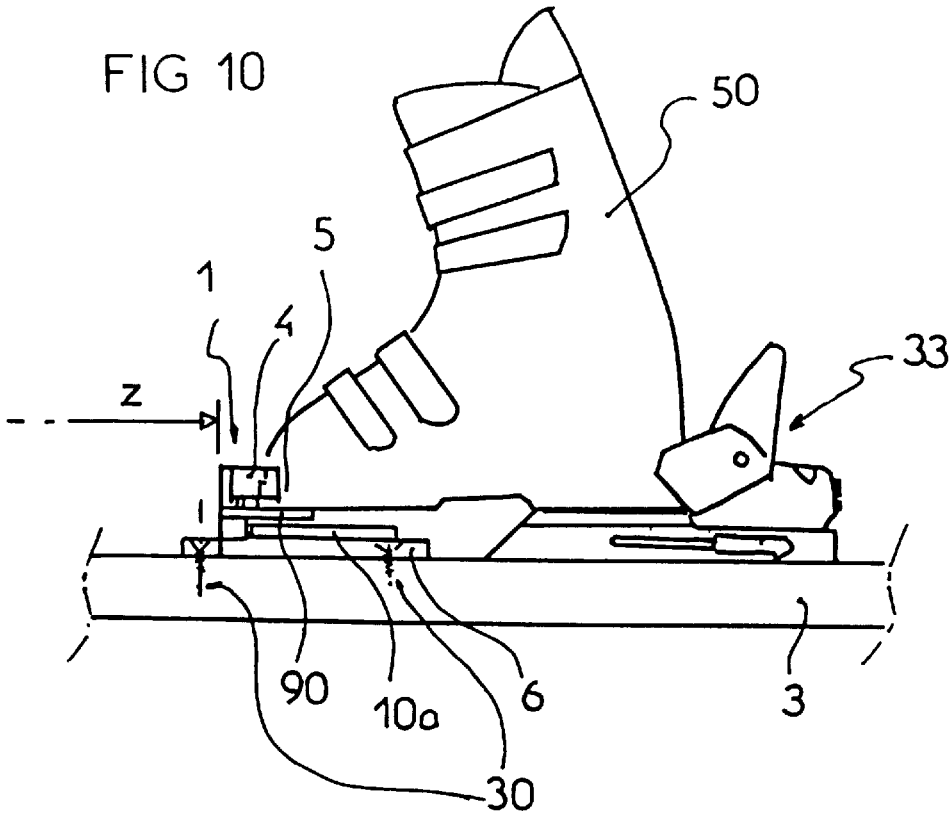
FIG. 10 shows a side view of a classical down-hill ski with a boot binding constructed in accordance with another embodiment of the invention.

With reference to FIG. 10, a second preferred embodiment of the invention will be described, wherein front binding 1 is utilized in conjunction with a classical downhill ski 3. In this embodiment, the base 6 is fixed to the associated ski 3 by the set of screws 30. It is to be appreciated that the embodiment of FIG. 10 can be beneficially utilized in conjunction with short-length skis or similar items such as skate boards, which typically have a length of less than one meter.

With respect to the two previously described applications, it is to be appreciated that the elastic return means 8 are advantageously arranged under the front end 5 of the associated boot 50 of the user. This arrangement frees a zone Z located in front of the jaw 4, which in the embodiment of FIGS. 8–9 permits the pivoting of the pivoting plate 25.

It is to be appreciated that the front boot retaining member, which in the embodiment of FIGS. 1–4 is the monobloc jaw 4, could be replaced by, for example, two demi-jaws (not shown), each of which articulates around a pivot axis and includes its own driving means equivalent to the cylindrical driving projection 9.

Figure 6:
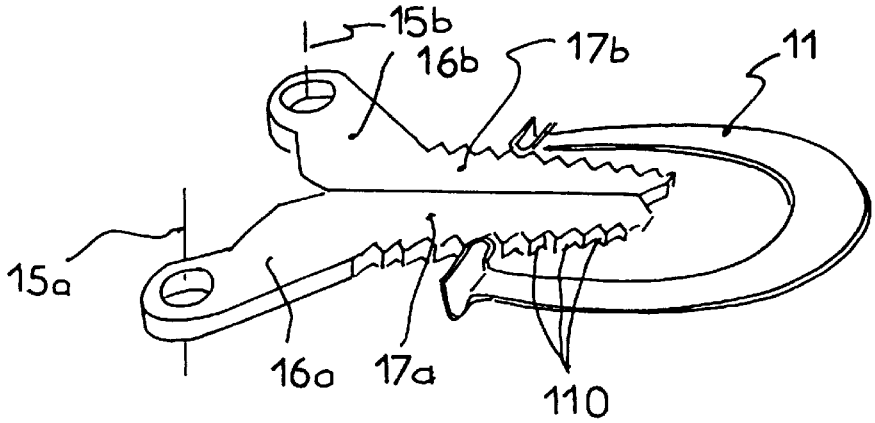
FIG. 6 shows the elastic return means in accordance with another embodiment of the invention.

It is to be further appreciated that any type of elastic system can be utilized for acting on the actuating arms 10*a,* 10*b*. With reference to FIG. 6, a system of deformable elasticity is described therefor. The elastic system includes a flat strap 11 made of a deformable material whose ends cooperate with the first portions 16*a*, 16*b* of each of the actuating arms 10*a,* 10*b*.

Figure 5:
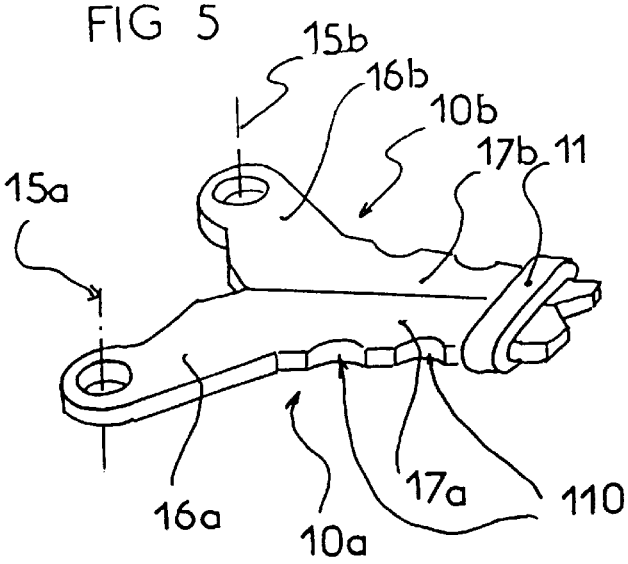
FIG. 5 shows the elastic return means in accordance with one embodiment of the invention.

According to the embodiments of the elastic system 11 illustrated in FIGS. 1–5 and FIG. 6, the impingement force is controlled by displacement of the point of action of the elastic system 11 towards the front or rear of the second portion 17*a*, 17*b,* whereby the pivot center of the arms is more or less elongated. To implement this approach, the external edge of each actuating arm is provided with a succession of notches 110 as shown in FIGS. 5 and 6.

Figure 7:
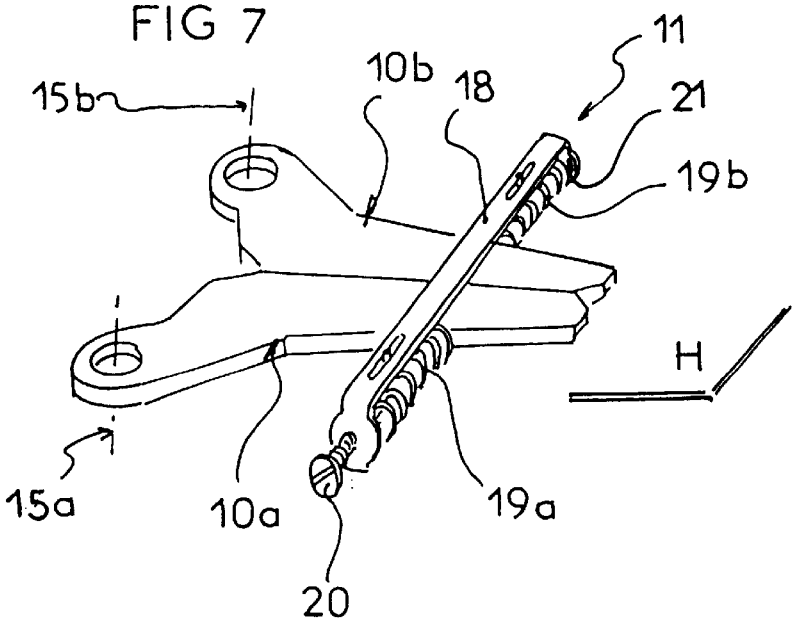
FIG. 7 shows the elastic return means in accordance with yet another embodiment of the invention.

Yet another embodiment of the elastic system 11 will be described with reference to FIG. 7, wherein the elastic system 11 includes at least one spring. In the illustrated embodiment of FIG. 7, a casing 18 includes two springs 19*a,* 19*b*. The first compression spring 19*a* is supported at one end by a control device 20, and at the other end by the first actuating arm 10*a*. The second compression spring 19*b* supported at one end by the bottom 21 of the casing 18 and at the other end by the second actuating arm 10*b*. It is to be appreciated that the two springs 19*a,* 19*b* are co-axial and that their respective axes are perpendicular to the plane of general symmetry P. The respective axes of the springs 19*a*, 19*b* are further beneficially located in a general plane H which also contains the two actuating arms 10*a,* 10*b* which are beneficially realized by a rectangular cut flat profile.

In the previously described embodiments, the two actuating arms 10*a*, 10*b* are symmetrical in relation to the plane of general symmetry P, but they may also be otherwise. For example, the pivot axes 15*a*, 15*b* may be arranged asymmetrically in relation to the plane of general symmetry P in order to not have the same disengagement force of the associated boot 50 toward the right and toward the left. One could also provide on each of the arms a different rail for realizing said effect.

From the previously given description, it will be appreciated that the actuating arms 10*a*, 10*b* are not integral parts of the jaw 4 but are connected with same kinematically.

It will be further appreciated that in the above embodiments, each of the actuating arms 10*a*, 10*b* is a lever of the third kind. As seen most clearly in FIG. 2, a point of application of effort A is arranged between a pivot point C and a point of resistance B which is the application point of the elastic system 11.

Figure 11:
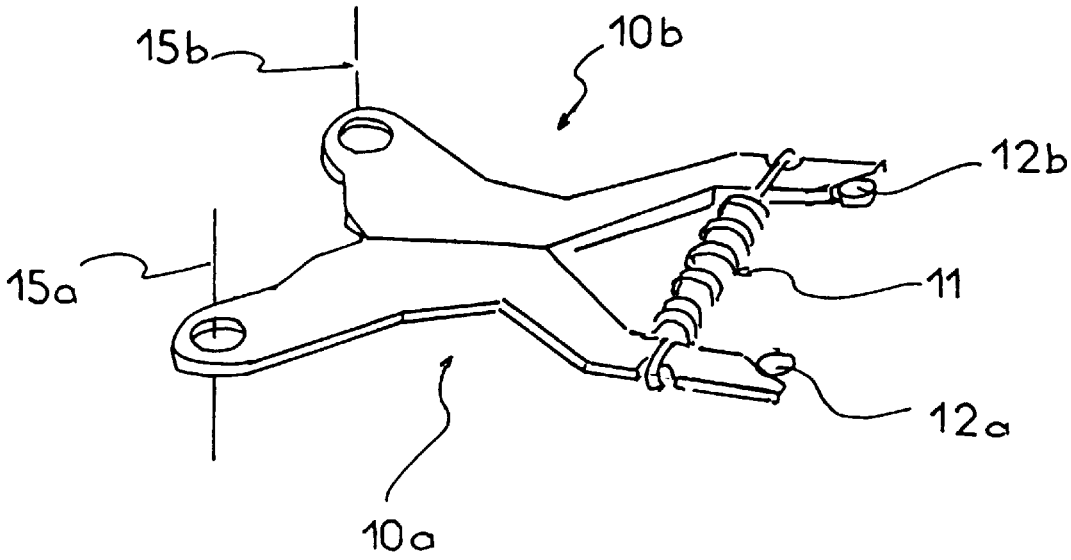
FIG. 11 shows the elastic return means in accordance with still yet another embodiment of the invention.

FIG. 11 is an illustration of still yet another embodiment of the elastic return means 8, according to which each of the actuating arms 10*a,* 10*b* is equipped with its own stop 12*a*, 12*b*. Thus, the left actuating arm 10*a* is supported on a stop 12*a*, whereas the right actuating arm 10*b* is supported on another stop 12*b,* the device thus including two stops 12*a*, 12*b*. In FIG. 11, the elastic system 11 includes a tension spring. However, the elastic system 11 may instead include an elastic ring as for example is illustrated in conjunction with the elastic return means 8 depicted in FIG. 5.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A retaining device for retaining a front end of a boot on ski, the retaining device comprising:

a base;

a movable jaw pivotally mounted to the base and pivoting around a vertical pivot axis; and a resilient biasing means which opposes the pivoting, the resilient biasing means including:

a driving element, two independent actuating arms each of which pivot about a respective pivot point and which cooperate with the jaw through the driving element, as the jaw pivots about the vertical pivot axis, the driving element drives a corresponding one of the actuating arms pivotally about its respective pivot point, and a resilient return system arranged under the front end of the associated boot in the rear of a transverse plane passing through the pivot axis of the jaw.

2. The retaining device as set forth in claim 1, further comprising:

a fixed support stop against which the resilient return system presses the two actuating arms.

3. The retaining device as set forth in claim 1, wherein:

the resilient return system includes an extensible element operatively maintained in either tension or compression.

4. The retaining device as set forth in claim 3, wherein:

the extensible element includes an elastomer material maintained in tension.

5. The retaining device as set forth in claim 1, wherein:

each of the two actuating arms is a lever in which an application point of force is arranged between the pivot point of the arm and a resistance point defined by an application point of the resilient return system.

6. The retaining device as set forth in claim 1, wherein:

the driving element includes a cylindrical driving projection extending downward with an axis, which axis is disposed rearwardly of the pivot axis of the jaw.

7. The retaining device as set forth in claim 6, further comprising:

a front plate which links the driving projection to the jaw and which plate extends approximately horizontally and on which plate the front end of the boot is supported.

8. The retaining device as set forth in claim 7, wherein:

the cylindrical driving projection is retained in a centered position by a plurality of actuating rails disposed on the two actuating arms.

9. The retaining device as set forth in claim 1, wherein each of the two actuating arms include:

a first portion which extends under a zone occupied by the front end of the associated boot; and a second portion which extends rearwardly from the first portion in side by side fashion, an extremity of the second portion being acted upon by the resilient return system against a fixed stop.

10. The retaining device as set forth in claim 1, wherein:

the base is fixed to the associated ski.

11. The retaining device as set forth in claim 1, further comprising:

a pivoting plate articulated at its front end around a transverse pivot axis, the pivoting plate disposed in such a manner that the base, the jaw, and the resilient return system are arranged in front of the pivoting plate.

12. The retaining device as set forth in claim 11, wherein:

the base is articulated around the transverse pivot axis and extends rearwardly, and supports the jaw, the resilient return system, and a boot heel retainer.

13. A retaining device for retaining a front end of a boot on a ski, the retaining device comprising:

a base;

a movable jaw pivotally mounted to the base and pivoting around a vertical pivot axis; and, a resilient biasing means which opposes the pivoting, the resilient biasing means including:

a driving element with a cylindrical driving projection extending downward with an axis, two independent actuating arms each of which pivot about a respective pivot point and which cooperate with the jaw through the driving element, as the jaw pivots about the vertical pivot axis, the driving element drives a corresponding one of the actuating arms pivotally about its respective pivot point, a resilient return system arranged under the front end of the associated boot in the rear of a transverse plane passing through the pivot axis of the jaw, a front plate which links the driving element to the jaw and which plate extends approximately horizontally, the driving projection being retained in a centered position by a plurality of actuating rails disposed on the two independent actuating arms, and, each of the plurality of actuating rails having a retaining first rail portion and a disengagement second rail portion, whereby the force required to pass the actuating element from the retaining first rail portion to the disengagement second rail portion defines a disengagement force value that releases the boot.

14. A ski binding comprising:

a base;

a boot toe retainer which releasably engages and supports a ski boot toe, the toe retainer being pivotally mounted to the base for rotation about a vertical axis adjacent a front edge thereof, such that the toe retainer pivots between a skiing position in which the boot toe is retained and a release position in which the boot toe is released;

at least one detent extending downward from the toe retainer rearward of the pivot axis along a longitudinal axis;

a pair of activating arms pivotally connected at front ends to the base between the pivot axis and the detent symmetrically to opposite sides of the longitudinal axis, the detent engaging both actuating arms in the skiing position and engaging only one of the arms in the pivoted boot toe releasing position; and a biasing element which biases a rearward portion of the actuating arms together to bias the toe retainer into the skiing position and which resiliently yields under lateral pressure allowing the toe retainer to pivot to the release position.

15. The ski binding as set forth in claim 14, wherein:

the base is pivotally mounted to a ski adjacent the toe retainer vertical axis to permit the ski boot to tip forward for cross country skiing.

* * * * *